US012593895B2

(12) United States Patent
Codega et al.

(10) Patent No.: US 12,593,895 B2
(45) Date of Patent: Apr. 7, 2026

(54) CONNECTION SYSTEM FOR CRAMPONS

(71) Applicant: CAMP S.P.A. COSTRUZIONE ARTICOLI MONTAGNA—PREMANA, Premana (IT)

(72) Inventors: Antonio Codega, Premana (IT); Andrea Donadoni, Premana (IT)

(73) Assignee: CAMP S.P.A. COSTRUZIONE ARTICOLI MONTAGNA—PREMANA, Premana (IT)

( * ) Notice: Subject to any disclaimer, the term of this patent is extended or adjusted under 35 U.S.C. 154(b) by 68 days.

(21) Appl. No.: 18/791,628

(22) Filed: Aug. 1, 2024

(65) Prior Publication Data

US 2025/0040664 A1 Feb. 6, 2025

(30) Foreign Application Priority Data

Aug. 3, 2023 (IT) ..... 102023000016512

(51) Int. Cl.
*A43C 15/06* (2006.01)

(52) U.S. Cl.
CPC ..... *A43C 15/063* (2013.01); *A43C 15/061* (2013.01); *A43C 15/066* (2013.01); *A43C 15/068* (2013.01)

(58) Field of Classification Search
None
See application file for complete search history.

(56) References Cited

U.S. PATENT DOCUMENTS 3,685,173 A * 8/1972 Piazza ..... A43C 15/068 36/64
3,786,579 A 1/1974 Clark et al.
4,344,238 A * 8/1982 Peyser ..... A43C 15/068 36/62

FOREIGN PATENT DOCUMENTS

DE 102016212445 A1 1/2018
EP 1348350 A1 * 10/2003 ..... A43B 3/26
EP 3437506 A1 2/2019
JP S478277 U 9/1972

OTHER PUBLICATIONS

English Translation of EP 1348350 (Year: 2003).*

* cited by examiner

*Primary Examiner* — Ted Kavanaugh
(74) *Attorney, Agent, or Firm* — CANTOR COLBURN LLP

(57) ABSTRACT

A crampon for ski mountaineering, mountaineering, or hiking boots includes a frame with front and rear portions connected by a longitudinal connecting rod, wherein the front portion includes retention elements and a support surface with a first coupling seat oriented at an angle relative to the crampon's axis, and the connecting rod includes at least one selector extending along an axis forming an angle with the crampon axis, such that by matching the angles of the selector and the coupling seat, the crampon can be configured for either a ski mountaineering boot or a mountaineering/hiking boot, thereby enabling optimal fit and secure attachment for different boot types.

18 Claims, 10 Drawing Sheets

CONNECTION SYSTEM FOR CRAMPONS

The present invention relates to a crampon, which is suitable for use with ski mountaineering boots and mountaineering boots.

As is known, crampons for mountain boots consist of a frame with rigid interconnected elements, equipped with sharp spikes projecting therefrom.

By virtue of these spikes, it is possible to grip on hard snow or ice and move along the path.

The frame is appropriately fastened to the boot so as to be in contact with the sole.

The frame can be a single piece or two pieces, a front one and a rear one, the distance of which is mutually adjustable by one or more longitudinal adjustment elements and fastenable in a certain position by one or more pin/hole couplings.

The need that crampons must fulfil is to be as integral as possible with the boot to which they are fastened; the greater the adhesion to the boot, the better the grip on the snow or ice will be and therefore the greater the safety of the mountaineer's support.

In order to obtain such an adhesion, the crampon must have a structure as similar as possible to the boot to which it is coupled.

As shown in FIG. 1A, the ski mountaineering boot S1 is typically characterized by a rectilinear sole, with a heel portion s1*p* and a toe portion s1*p* having a same longitudinal axis p,p'; this is because the ski mountaineering boot must be attached to the skis.

On the contrary, when the mountaineer practices mountaineering or hiking, as shown in FIG. 1B, the mountaineer wears a boot with a more shaped sole, the toe portion s2*a* of the boot is characterized by an axis p' having an inclination of an angle α with respect to the longitudinal axis p of the heel portion s2*p*.

There are no known crampons that can be suitable for both types of boots and that ensure optimal adhesion to the sole, without "clearances", i.e. small movements, between the crampon and the boot.

Such "clearances" not only render the movement less steady, but also reduce the mountaineer's sensitivity to the sole and create room where snow or ice can possibly enter and stick, further compromising the crampon functionality and safety.

The use of additional elements to stabilize the shape of the crampon is a feasible but impractical solution, because it requires carrying additional pieces to be assembled often under complex conditions (due to logistical position or atmospheric conditions).

In reality, the most successful systems are also the simplest ones.

The present invention provides a crampon and a set of two crampons adapted to be optimally coupled to both a mountaineering and hiking boot and a ski mountaineering boot.

Such an object is achieved by a crampon according to claim 1 and the dependent claims.

The solution idea underlying the present invention is the provision of a mountain crampon, where the connecting element between the front portion and the rear portion of the crampon can take two different configurations.

In order to better understand the invention, the following is a description of exemplary and non-limiting embodiments thereof, shown in the accompanying drawings, in which.

Figure 5A:
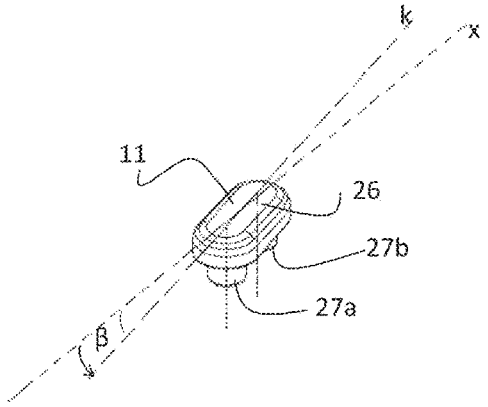
Figure 5B:
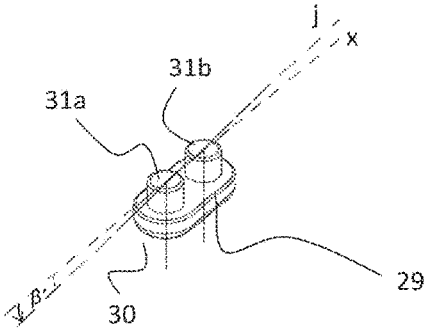
Figure 6:
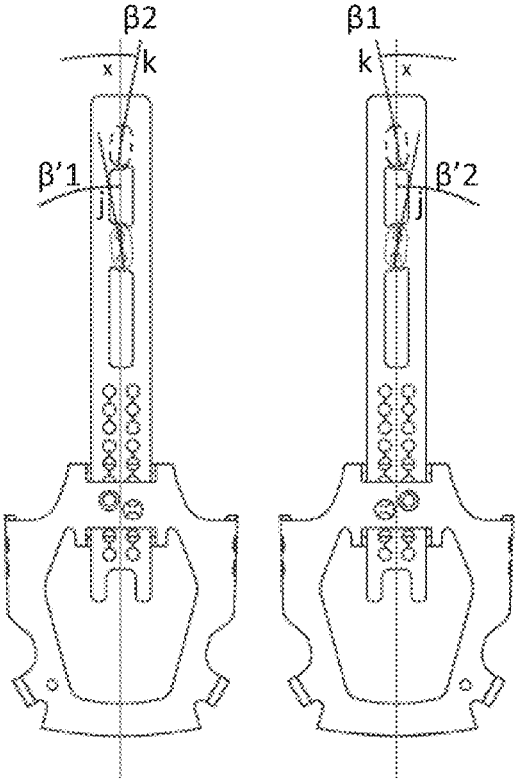
Figure 7A:
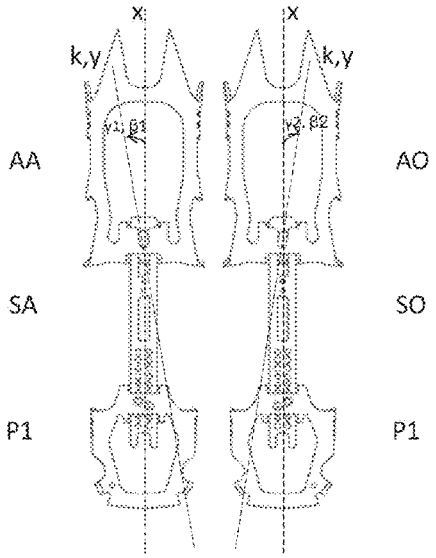
Figure 7B:
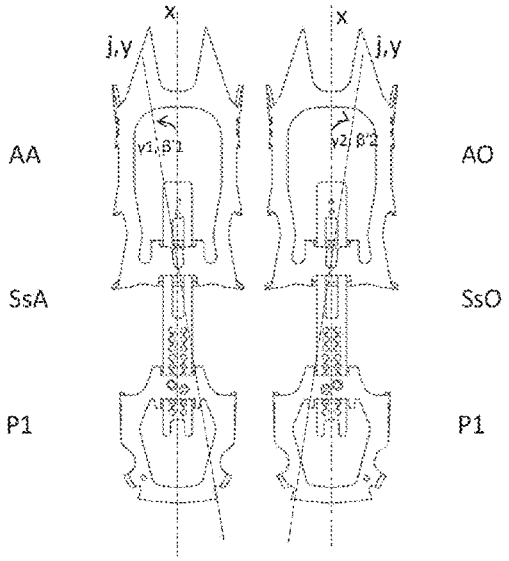
Figure 8A:
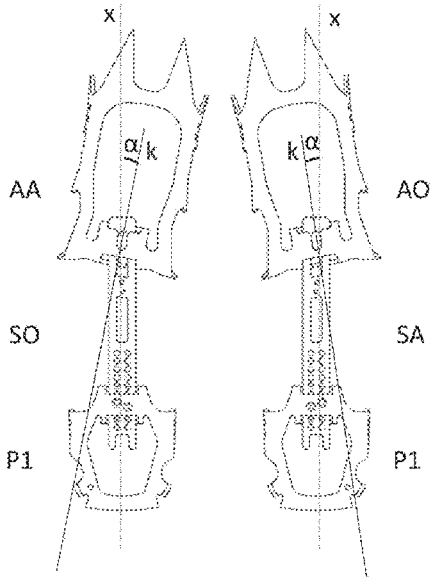
Figure 8B:
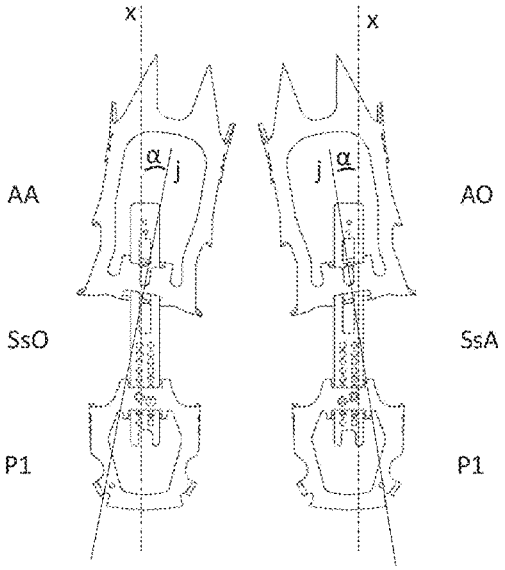
Figure 9A:
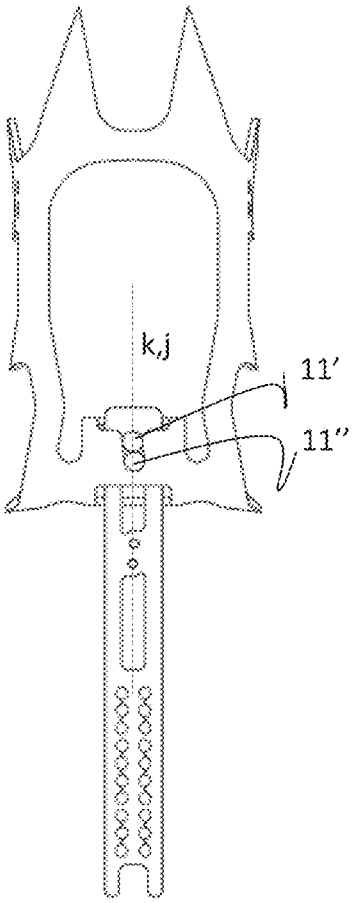
Figure 10:
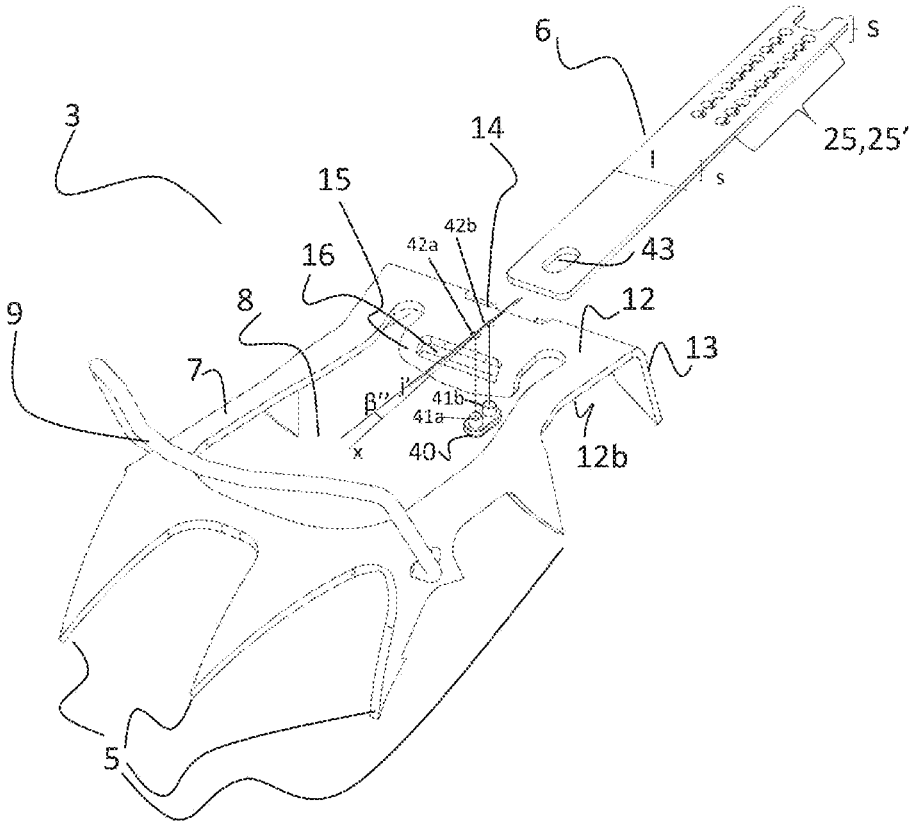

FIGS. 5A-B shows the first selector and the second selector;

FIG. 6 shows the alternative coupling means of the rod;

FIG. 7A shows the "large" ski mountaineering configuration and FIG. 7B the "small" ski mountaineering configuration according to the present invention;

FIG. 8A shows the "large" mountaineering configuration and FIG. 8B the "small" mountaineering configuration according to the present invention;

FIG. 9 shows alternative connection systems between the front part of the crampon and the connecting rod;

FIG. 10 shows an alternative embodiment of the present invention.

In the following description, the term "proximal" and "distal" are to be considered with reference to the configuration in which the crampons are in use by the mountaineering or hiking user; therefore, a "proximal" position is rear position which is closer to the user and "distal" position is a front position which is further away.

In the following description, the terms "right" and "left" have their own meaning.

In the following description, the term "inward" shall be intended towards the internal or toward the other boot or crampon, while "outward" shall be intended versus the opposite side.

An ice crampon according to the present invention is generally indicated by reference numeral 1, extends along a longitudinal axis of the crampon x, and comprises a frame 100 having a front portion 3 and a rear portion 4, that can be connected to each other by a connecting rod 6.

The frame 100 has a suitable thickness s'.

For the purposes of the present invention, the longitudinal axis x of the crampon crosses the crampon longitudinally, i.e., according to the its main longitudinal extension thereof, dividing it according to the sagittal plane.

Both the front portion 3 and the rear portion 4 of the crampon comprise a plurality of spikes 5 for moving on snow or ice.

Figure 4:
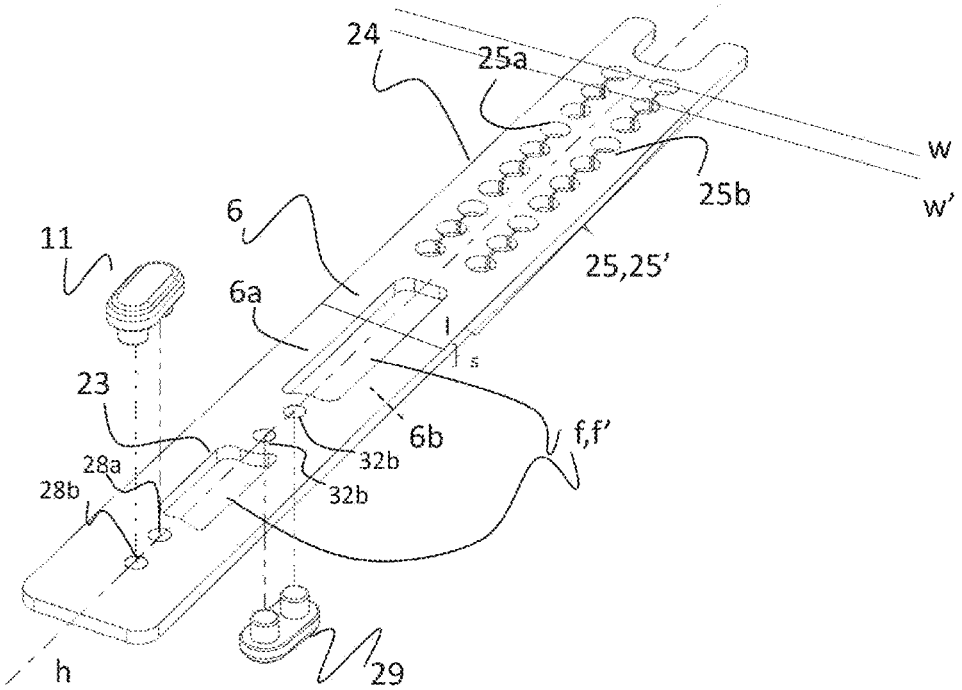
FIG. 4 shows the connecting rod, the first front connection means of the rod, and the alternative connection means of the rod.

As better shown in FIG. 4, the connecting rod 6 has an elongated shape along its longitudinal axis h with an upper face 6*a* and a lower face 6*b*, a width 1 and a thickness s; the connecting rod 6 can comprise one or more lightening windows f,f' for lightening the frame 100.

Figure 2:
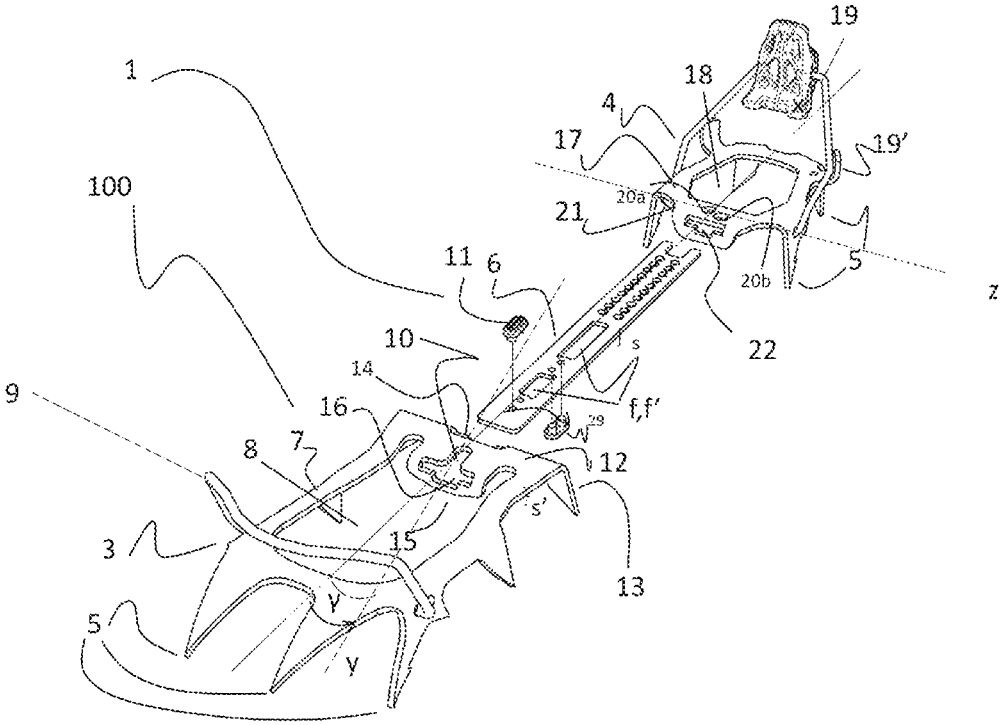
FIG. 2 shows an "exploded" view of a crampon according to an embodiment of the invention.

With reference to FIG. 2, the front portion 3 comprises a support surface 7 of the toe portion of the boot sole, optionally a front lightening window 8, retention means 9 of the toe portion of the boot s1*a*,s2*a*, and front/distal connection means with the connecting rod 6.

The retention means of the toe portion of the boot s1*a*,s2*a* may be represented by elastic means 9 or by elastically connected means.

The support surface 7 of the toe portion of the boot sole comprises front connection means for the connection with the connecting rod 6.

Such means are represented by a first coupling seat 10 to be coupled to first coupling means of the rod, described in more detail below.

In a preferred aspect of the invention, such first coupling seat 10 is a through window.

In a preferred embodiment, said first coupling seat 10 is obtained in the proximal portion 12 of the support surface of the toe portion of the boot sole.

Figure 3A:
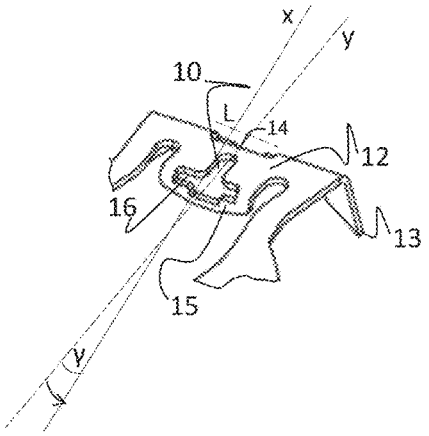
FIG. 3 shows the detail of the front connection means of the rod (3A) and the rear connection means of the rod (3B)
Figure 3B:
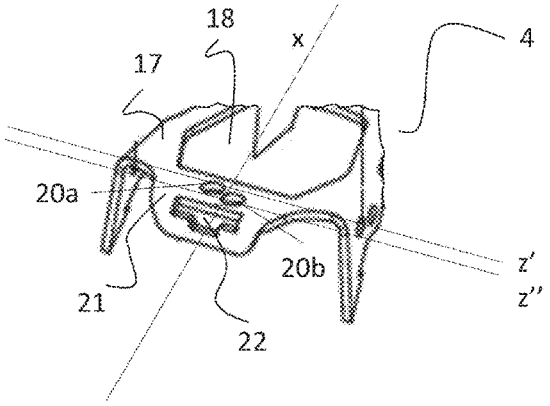

For the purposes of the present invention, as shown in FIG. 3, the first coupling seat 10 has an elongated shape, for instance oval or rectangular with rounded corners, and extends along an axis y indicated in the figure.

For the purposes of the present invention, the axis y of the first coupling seat forms an angle γ with the longitudinal axis x of the crampon.

According to a first embodiment of the invention (indicated as AA), the angle γ between the longitudinal axis of the crampon x and the longitudinal axis y of the first coupling seat (10), is a counterclockwise angle γ1, i.e., towards the external of the crampon 1.

In a second embodiment of the invention (indicated AO), the angle γ between the longitudinal axis of the crampon x and the longitudinal axis y of the first coupling seat, is a clockwise angle γ2, i.e. towards the internal of the crampon 1.

In a preferred embodiment, the support surface 7 of the portion of the boot sole comprises further front connection means of the connecting rod 6.

In particular, the proximal portion 12 of the toe portion of the boot sole support surface may comprise a proximal edge 13 folded downwards at the back comprising a first front insertion window 14 of the connecting rod.

In an aspect of the invention, said first front insertion window 14 has a height at least corresponding to the thickness s of the rod and a greater width L than the width 1 of the rod.

The first front insertion window 14 and the first coupling seat 10 can be portions of one single front insertion and coupling window of the rod.

In a preferred embodiment, the proximal portion 12 of the toe portion of the boot sole support surface may comprise further front connection means of the connecting rod 6.

In particular, the proximal portion 12 of the toe portion of the boot sole support surface may comprise a distal edge 15 folded downwards comprising a second front insertion window 16 of the connecting rod 6.

In the embodiment of the invention shown in FIG. 2, the second front insertion window 16 and the first coupling seat 10 may be portions of one single front insertion and coupling window of the rod 6.

With reference to FIG. 2, the rear portion 4 of the crampon comprises a support surface of the heel portion 17 of the boot surface, possibly a rear lightening window 18, retention means of the boot heel, and rear connection means for the connection with the connecting rod 6.

The retention means of the boot heel may comprise elastic means 19 and/or fixed means 19' for retaining the heel portion of the boot s1*p*,s2*p*.

According to a preferred embodiment of the invention, the support surface 17 of the boot heel portion may comprises rear connection means for the connection with the connecting rod 6.

They may be represented for instance by one rear hole 20 (not shown in FIG. 2) or preferably by a plurality of rear holes for bolt fastening to the connecting rod 6, as described below.

According to an embodiment of the invention (not shown in the figures), in the distal portion 21 of the support surface of the heel portion of the boot there may be provided two rear fastening holes 20*a*,20*b*, which are arranged on the same transverse axis z x of the crampon.

According to another embodiment of the invention (shown in FIGS. 2 and 3B, for example), the two rear holes 20*a*,20*b* may be arranged, respectively, on a first transverse axis z' and on a second transverse axis z", wherein the first transverse axis z' is more proximal than the second transverse axis z".

According to one embodiment, the first hole 20*a* may be arranged inwardly with respect to the longitudinal axis x of the crampon and the second hole 20*b* may be arranged outwardly, so that the inner hole 20*a* is proximal and the outer hole 20*b* is distal (configuration P1).

Advantageously, said configuration allows a higher stability for the crampon 1.

In a preferred embodiment, the support surface of the heel portion 17 of the boot comprises further rear connection means of the connecting rod 6.

In particular, the distal portion of the support surface 17 of the heel portion of the boot may comprise a distal edge 21 folded downwards comprising a rear insertion window 22 for the connecting rod 6.

For the purposes of the present invention, the connection between the rear portion 4 of the crampon and the connecting rod 6 is along the longitudinal axis x of the crampon.

As shown in FIG. 2 and in FIG. 4, the connecting rod 6 has a front connecting portion 23 for the connection with the front portion 3 of the crampon and a rear connecting portion 24 for the connection with the rear portion 4 of the crampon.

The rear connecting portion 24 of the rod comprises bolt coupling means represented by one hole 25 or preferably a plurality of holes 25' arranged along the longitudinal axis h of the connecting rod or along one or more axis parallel thereto.

Advantageously, said plurality of holes 25' allows to adjust the distance between the front portion 3 and the rear portion 4 of the crampon.

According to a preferred embodiment, there may be provided a right row 25*a* and a left row 25*b* of holes with respect to the longitudinal axis h.

As shown in FIG. 4, the holes of the plurality of holes 25' are also aligned along transverse axes w, W'.

For the bolt connection between the rear portion of the crampon and the connecting rod, one or more holes of the plurality of holes 25,25' are coupled to corresponding bolt coupling holes 20*a*,20*b* of the rear portion 4 of the crampon.

As for the front coupling portion 23 of the rod, it comprises first front coupling means of the rod on the upper face 6*a* of the rod adapted to be inserted into the first coupling seat 10 of the front portion 3 of the crampon.

According to an embodiment of the present invention, said first coupling means of the rod 6 are represented by a first selector 11 having an elongated shape, for instance oval or rectangular with rounded corners, and which extends along a longitudinal axis of the first selector k indicated in FIG. 5A.

For the purposes of the present invention, said longitudinal axis of the first selector k forms an angle β with the longitudinal axis x of the crampon.

According to a first embodiment of the invention (indicated SA), the angle β with the longitudinal axis x of the crampon is a counterclockwise angle β1.

In a second embodiment of the invention (indicated SO), the angle β with the longitudinal axis x of the crampon is a clockwise angle β2.

As for the amplitude of the angle β, it is such that, when added to the amplitude of the angle γ of the first coupling seat 10 of the front portion of the crampon, it corresponds to the amplitude of the angle α of inclination of the axis p' of the toe portion of the boot (β+γ=α).

In an embodiment of the invention, not shown in the figures, such first selector 11 is made as a single body with the rod 6 and is thus unmovable.

In an alternative embodiment, for instance shown in FIG. 2, the first selector 11 is applicable to the rod 6 and then fastened thereto.

As shown in Figure said first selector 11 comprises a head portion 26 having an elongated shape along the longitudinal axis k of the first selector as described above and connecting means for the connection with the connecting rod 6.

Said connecting means for the connection with the connecting rod 6 may be represented by a pin or in the form of one or more pins 27*a*,27*b*.

In particular, said one or more pins 27*a*,27*b* are suitable for being inserted into one or more corresponding holes 28*a*,28*b* for the pins of the first selector obtained in the thickness s of the rod.

According to a further embodiment of the invention, on the lower face of the rod 6*b* there are alternative front coupling means of the rod.

In a preferred aspect of the invention, said alternative front coupling means are in a more proximal position with respect to the front coupling means.

Advantageously, said alternative front coupling means are used when it is necessary to further adjust the crampon 1 to adapt it to the length of the boot (small alternative configuration).

Said alternative front coupling means can be used by overturning the rod so that the lower face 6*b* faces the sole of the boot.

As shown for instance in FIGS. 4 and 5B the alternative coupling means also are suitable for being inserted into the first coupling seat 10 of the front portion 3 of the crampon.

According to an aspect of the present invention, said alternative coupling means are in the form of a second selector 29, having an elongated shape, for instance oval or rectangular with rounded corners, and extends along a longitudinal axis j of the second selector.

For the purposes of the present invention, said longitudinal axis j of the second selector forms an angle β' with the longitudinal axis x of the crampon.

According to a first embodiment of the invention (indicated SsA), the angle β' with the longitudinal axis x of the crampon is a counterclockwise angle β'1.

In a second embodiment of the invention (indicated SsO), the angle β' with the longitudinal axis x of the crampon is a clockwise angle β'2.

As for the amplitude of the angle β', it is such that, when added to the amplitude of the angle γ of the first coupling seat 10 of the front portion of the crampon, it corresponds to the amplitude of the angle α of inclination of the axis p' of the toe portion of the boot.

In an embodiment of the invention, not shown in the figures, such a second selector 29 is made as a single body with the rod 6 and is thus unmovable.

In an alternative embodiment of the invention, shown for instance in FIGS. 4 and 5B, the second selector 29 is applicable to the rod 6 and then fastened thereto.

As shown in FIG. 5B, said second selector 29 comprises a head portion 30 having an elongated shape along its longitudinal axis j as described above and connecting means for the connection with the connecting rod 6.

Said connecting means of the second selector 29 for the connection with the connecting rod 6 can be represented by a pin (not shown in the figures) or by one or more pins 31*a*,31*b* (FIG. 5B).

In particular, said one or more pins 31*a*,31*b* are suitable for being inserted into one or more corresponding holes 32*a*,32*b* of the connecting rod 6, as shown in FIG. 4.

Figure 9B:
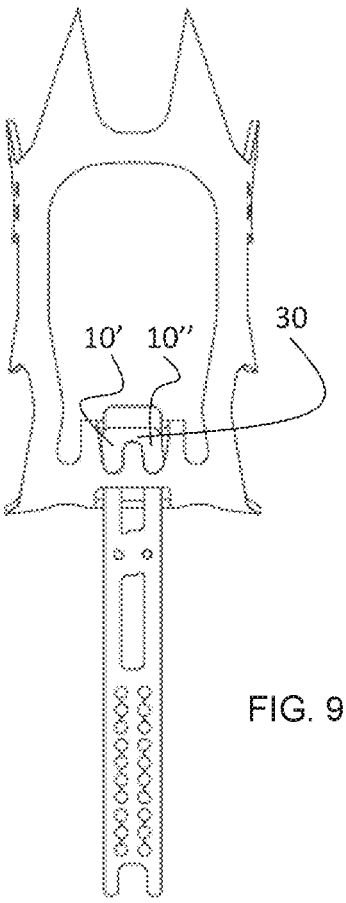

According to alternative embodiments of the invention, for instance shown FIG. 9, the connecting system between the first coupling seat 10 and the front connection means for the connection with the connecting rod 6 can occur in one of the following ways:

- the first selector 11 or the second selector 29 may be in the form of two or more pins 11',11" along their respective longitudinal axis k or j (FIG. 9A);
- the first coupling seat 10 may comprise two or more seat sub-portions 10',10" along the longitudinal axis y and it is coupled with an overturned U-shaped selector 30 (FIG. 9B).

According to the above description, there may be obtained:

- a right rod, which comprises the above-described configurations SO and, by overturning it, SsO, and
- a left rod, which comprises the above-described configurations SA and, by overturning it, SsA.

According to the present invention, a crampon 1 is thus described in a first configuration adapted for use in association with a ski mountaineering boot.

Advantageously, said configuration can be adapted to a large configuration and an alternative small configuration.

In particular, as shown in FIGS. 7A and 7B, for a crampon to be associated with a left boot in the ski mountaineering configuration, it is necessary to couple together:

- a front portion 3 of the crampon in configuration AA, and
- a connecting rod 6 in configuration SA (large, FIG. 7A) or SsA (small, FIG. 7B),
- together with a rear portion 4 of the crampon, which is optionally in configuration P1;
- whereas for a crampon to be associated with a right boot in the ski mountaineering configuration, it is necessary to couple together:
- a front portion 3 of the crampon in configuration AO, and
- a connecting rod 6 in configuration SO (large, FIG. 7A) or SsO (small, FIG. 7B),
- together with a rear portion 4 of the crampon, which is optionally in configuration P1.

For the purposes of the present invention, in the ski mountaineering configuration, the angle β and the angle γ are of equal amplitude, and in the combination of the configurations AA-SA and AO-SO, the angle formed between the longitudinal axis x of the crampon and the longitudinal axis p of the ski mountaineering boot corresponds to β−γ=Δ; for a ski mountaineering boot it is Δ=0°.

According to the present invention, as shown in FIGS. 8A and 8B, a crampon is also described in a second configuration adapted for use in association with a mountaineering or hiking boot.

Advantageously, said configuration can be adapted to a large configuration and an alternative small configuration.

In particular, as shown in FIGS. 7A and 7B for a crampon to be associated with a left boot in the mountaineering or hiking configuration, it is necessary to couple together:

- a front portion 3 of the crampon in configuration AA, and
- a connecting rod 6 in configuration SO (large, FIG. 8A) or SsO (small, FIG. 8B), whereas for a crampon to be associated with a right boot in the mountaineering or hiking configuration, it is necessary to couple together:

a front portion 3 of the crampon in configuration AO, and a connecting rod 6 in configuration SA (large, FIG. 8A) or SsA (small, FIG. 8B).

In the mountaineering or hiking configuration, the angle formed between the longitudinal axis x of the crampon and the p' axis of the toe portion of the booth sole corresponds to $\beta+\gamma=\alpha$.

Normally, for a mountaineering or hiking boot, $\alpha$ is $0°<\alpha<30°$.

Therefore, in the large configuration $\beta+\gamma=\alpha$, whereas in the alternative small configuration $\beta'+\gamma=\alpha$.

Therefore, according to an advantageous embodiment of the present invention, the configuration of the crampon to be associated with a ski mountaineering boot can be converted into the configuration of the crampon to be associated with a mountaineering or hiking boot by exchanging the right rod with the left rod.

Furthermore, as it can be understood from the above description, according to another advantageous aspect of the present invention, the large configuration of the crampon can be converted into the alternative small configuration of the crampon by overturning the connecting rod 6 and using the alternative front coupling means.

According to a further embodiment, for instance shown in FIG. 10, the first selector 11 or the second selector 29 may be fitted onto the front portion 3 of the crampon and the first coupling seat 10 onto the connecting rod 6.

A further embodiment of the crampon of the present invention is shown in FIG. 10.

The figure shows the front portion 3 of the crampon with the spikes 5 for moving on the snow or ice and the connecting rod 6.

The crampon has a longitudinal axis x according to its main longitudinal extension dividing it according to a sagittal plane.

The connecting rod 6 has an elongated shape along its longitudinal axis h with an upper face 6*a* and a lower face 6*b*, a width 1 (and a thickness s; the connecting rod 6 can comprise one or more lightening windows (not shown in FIG. 10).

The front portion 3 of the crampon comprises a support surface 7 of toe portion of the boot sole, possibly a front lightening window 8, retention means 9 of the front portion of the boot, and front connection means for the connection with the connecting rod 6.

According to an embodiment of the invention, the support surface 7 of the toe portion of the boot sole comprises front connection means for the connection with the connecting rod 6.

The front connection means of the connecting rod 6 may be represented by a third selector 40 fitted onto a lower face 12*b* of the proximal portion 12 of the support surface of the toe portion of the boot sole.

Said third selector 40 has an elongated shape, for instance oval or rectangular with rounded corners, and extends along a longitudinal axis j' of the third selector shown in FIG. 10.

For the purposes of the present invention, said longitudinal axis j' forms an angle $\beta''$ with the longitudinal axis x of the crampon.

In an embodiment of the invention, not shown in the figures, the third selector 40 may be made as a single body with the connecting rod 6 and it is thus unmovable.

In an alternative embodiment of the invention for instance shown in FIG. 10, the selector 40 is applicable to the connecting rod 6 and then fastened thereto.

As shown in FIG. 10, said third selector 40 comprises a head portion having an elongated shape along its longitudinal axis j' as described above and connecting means for the connection with the rod 6.

Said connecting means for the connection with the connecting rod 6 may be represented by a pin or by one or more pins 41*a*,41*b*.

In particular, said one or more pins 41*a*,41*b* are suitable for being inserted into one or more corresponding holes 42*a*,42*b* for the pins of the third selector 40 obtained in the thickness s' of the frame.

As described above in connection with other embodiments, the connecting rod 6 has a front connecting portion 23 for the connection with the front portion 3 of the crampon and a rear connecting portion 24 for the connection with the rear portion 4 of the crampon. ( As for the front connecting portion 23 of the connecting rod 6, it may comprise a second coupling seat 43 obtained in the thickness s.

According to a preferred embodiment, said second coupling seat 43 is in the form of a through window.

The second coupling seat 43 has an elongated shape, for instance oval or rectangular with rounded corners, and extends along a longitudinal axis h' of the third connecting seat (not indicated in FIG. 10).

For the purposes of the present invention, the axis h' of the third coupling seat forms an angle $\gamma'$ with the longitudinal axis x of the crampon.

According to a first embodiment of the invention (indicated SA'), the angle $\beta''$ with the longitudinal axis x of the crampon is a counterclockwise angle $\beta''$1.

In a second embodiment of the invention (indicated SO'), the angle $\beta''$ with the longitudinal axis x of the crampon is a clockwise angle $\beta''$2.

As for the amplitude of the angle $\beta''$, it is such that, when added to the amplitude of the angle $\gamma'$ of the third connecting seat 43, it corresponds to the amplitude of the angle $\alpha$ of inclination p' of the toe portion of the boot sole with respect ($\beta''+\gamma'=\alpha$).

Figure 1A:
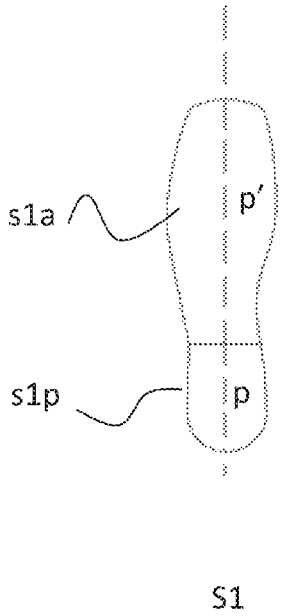
FIG. 1A (Prior Art)
FIG. 1A depicts the sole of a ski mountaineering boot and FIG. 1B depicts the sole of a mountaineering boot highlighting the angle of inclination α of the toe portion s1*a*,s2*a* of each boot with respect to the heel portion s1*p*,s2*p;*
Figure 1B:
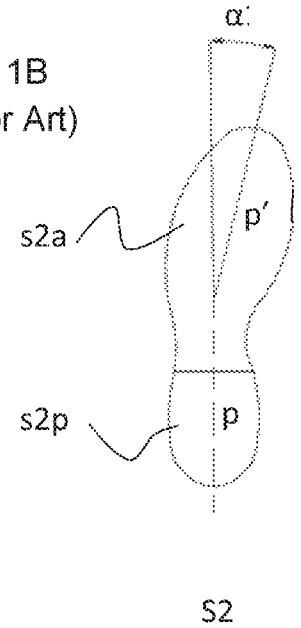
FIG. 1B (Prior Art)

The present invention thus discloses a set of crampons for ski mountaineering boots and in particular for the left ski mountaineering boot S1 of FIG. 1 and for the right ski mountaineering boot S1' not shown in FIG. 1.

In a first embodiment, said set of crampons may be in a large configuration wherein the left crampon (S1LL) comprises a front portion (3) wherein the angle $\gamma$ between the longitudinal axis of the crampon x and the longitudinal axis y of the first coupling seat (10) is a counterclockwise angle $\gamma$1, the connecting rod (6) comprises said first selector (11) wherein the longitudinal axis of the first selector k forms a counterclockwise angle $\beta$1 with the longitudinal axis x of the crampon, and wherein said right crampon (S1LR) comprises a front portion (3) wherein the angle $\gamma$ between the longitudinal axis of the crampon x and the longitudinal axis y of the first coupling seat (10) is a clockwise angle $\gamma$2, the connecting rod (6) comprises said first selector (11) wherein the longitudinal axis of the first selector k forms a clockwise angle $\beta$2 with the longitudinal axis x of the crampon.

In a second embodiment, said set of crampons may be in a small configuration wherein said left crampon (S1SL) comprises a front portion (3) wherein the angle $\gamma$ between the longitudinal axis of the crampon x and the longitudinal axis y of the first coupling seat (10) is a counterclockwise angle $\gamma$1, the connecting rod (6) comprises said second selector (29) wherein the longitudinal axis j of said second selector forms a counterclockwise angle β'1 with the longitudinal axis x of the crampon, and wherein said right crampon (1SSR) comprises a front portion (3) wherein the angle γ between the longitudinal axis of the crampon x and the longitudinal axis y of the first coupling seat is a clockwise angle γ2, the connecting rod (6) comprises said second selector (29) wherein the longitudinal axis j of said second selector forms a clockwise angle β'2 with the longitudinal axis of the crampon.

The present invention further discloses a set of crampons for mountaineering or hiking boots and in particular for the left mountaineering or hiking boot S2 of FIG. 1 and for the right mountaineering or hiking boot S2' not shown in FIG. 1.

In a first embodiment, said set of crampons may be in a large configuration wherein said left crampon (S2LL) comprises a front portion (3) wherein the angle γ between the longitudinal axis of the crampon x and the longitudinal axis y of the first coupling seat (10) is a counterclockwise angle γ1, the connecting rod (6) comprises said first selector (11) wherein the longitudinal axis of the first selector k forms a clockwise angle β2 with the longitudinal axis x of the crampon, and wherein the right crampon (S2LR) comprises a front portion (3) wherein the angle γ between the longitudinal axis of the crampon x and the longitudinal axis y of the first coupling seat is a clockwise angle γ2, the connecting rod (6) comprises said first selector (11) wherein the longitudinal axis of the first selector k forms a counterclockwise angle β1 with the longitudinal axis x of the crampon.

In a second embodiment, said set of crampons may be in a small configuration wherein said left crampon (SSL) comprises a front portion (3) wherein the angle γ between the longitudinal axis of the crampon x and the longitudinal axis y of the first coupling seat (10) is a counterclockwise angle γ1, the connecting rod (6) comprises said second selector (29) wherein the longitudinal axis j of said second selector forms a clockwise angle β'2 with the longitudinal axis x of the crampon, and the right crampon (S2SR) comprises a front portion (3) wherein the angle γ between the longitudinal axis of the crampon x and the longitudinal axis y of the first coupling seat is a clockwise angle γ2, the connecting rod (6) comprises said second selector (29) wherein the longitudinal axis of the second selector k forms a counterclockwise angle with β'1 the longitudinal axis of the crampon.

From the above description, the advantages of the present invention will be immediately apparent.

In particular, the crampon described is capable of offering a functional solution in both configurations for a mountaineering or hiking boot or for a ski mountaineering boot.

The crampon described has shown to be stable and offer an optimal lateral rigidity without compromising the safety of the crampon itself.

The further advantage of versatility meets the need to practice several disciplines using a single product.

Those skilled in the art will be able to make changes or adaptations to the crampon of the present invention, without however departing from the scope of the following claims.

The invention claimed is:

1. A crampon for a ski mountaineering boot having a heel portion and a toe portion or for mountaineering or hiking boot having a heel portion and a toe portion, said crampon having a frame with a thickness and comprising a front portion and a rear portion connectable to each other by a connecting rod extending along a longitudinal axis h of said connecting rod and having an upper face and a lower face, a width and a thickness, said crampon extending along a longitudinal axis x of the crampon, wherein said front portion frame comprises retention means for a front portion of the boot and a support surface for a toe portion of a sole of the boot comprising front connection means for the connection with the connecting rod comprising a first coupling seat for first coupling means of the connecting rod, wherein said connecting rod comprises first front coupling means comprising a first selector and a second selector adapted to be inserted into the first connecting seat, wherein said first connecting seat extends along a longitudinal axis y of said first connecting seat which forms an angle γ with the longitudinal axis x of the crampon, wherein said angle γ can be counterclockwise or clockwise, and wherein said first selector and said second selector extends along a respective longitudinal axis k,j, which forms an angle with the longitudinal crampon axis x, wherein said angle can be counterclockwise or clockwise, so that when said first selector and said second selector forms a counterclockwise angle and is or are coupled to the first connecting seat having a counterclockwise angle or when said first selector and said second selector forms a clockwise angle and is or are coupled to the first connecting seat having a clockwise angle, said crampon is configured for a ski mountaineering boot, whereas when first selector and said second selector forms a counterclockwise angle and is or are coupled to the first connecting seat having a clockwise angle or said first selector and said second selector forms a clockwise angle and is or are coupled to the first connecting seat having a counterclockwise angle, said crampon is configured for a mountaineering or hiking boot.

2. A crampon according to the claim 1, wherein each of said first selector and second selector are on the upper face or on the lower face of said connecting rod, independently of each other.

3. A crampon according to claim 1, wherein said second selector is in a position more proximal with respect to the first selector.

4. A crampon according to claim 1, wherein each of said first selector and second selector are made as a single body with said connecting rod or applied and fastened thereto, independently of each other.

5. A crampon according to claim 1, wherein said first connecting seat is obtained in a proximal portion of the support surface of the toe portion of the boot sole of the crampon.

6. A crampon according to claim 1, wherein said proximal portion of the support surface of the toe portion of the boot sole further comprises a proximal edge folded downwards at the back comprising a first front insertion window of the connecting rod.

7. A crampon according to claim 6, wherein said first front insertion window and said first coupling seat are portions of one single front insertion and coupling window of the rod.

8. A crampon according to claim 1, wherein said proximal portion of the support surface of the toe portion of the comprises a distal edge folded downwards at the front comprising a second front insertion window of the connecting rod.

9. A crampon according to claim 8, wherein said second front insertion window and said first coupling seat are portions of one single front insertion and coupling window of the rod.

10. A crampon according to claim 1, wherein said rod further comprises connection means for the connection with the rear portion of the crampon.

11. A crampon according to claim 10, wherein said rear portion of the crampon comprises rear connection means for the bolted connection with the rear connection means of the connecting rod.

12. A crampon according to claim 1, wherein said rear portion of the crampon comprises a distal portion of the heel support surface comprising a rear insertion window of the connecting rod.

13. A crampon according to claim 1, wherein said first selector and/or the second selector is in the form of two or more pins (11',11") extending along their longitudinal axis k,j.

14. A crampon according to claim 1, wherein said first coupling seat comprises two or more seat sub-portions along the longitudinal axis y with an overturned U-shaped selector.

15. A set of two crampons according to claim 1, comprising a left crampon and a right crampons to be coupled to a respective left and right ski mountaineering boots, said left crampon comprising a front portion wherein the angle γ between the longitudinal axis of the crampon x and the longitudinal axis y of the first coupling seat is a counterclockwise angle γ1, the connecting rod comprising said first selector wherein the longitudinal axis of the first selector k forms a counterclockwise angle β1 with the longitudinal axis x of the crampon, and said right crampon comprising a front portion wherein the angle γ between the longitudinal axis of the crampon x and the longitudinal axis y of the first coupling seat is a clockwise angle γ2, the connecting rod comprising said first selector wherein the longitudinal axis of the first selector k forms a clockwise angle β2 with the longitudinal axis x of the crampon.

16. A set of two crampons according to claim 1, comprising a left crampon and a right crampons to be coupled to a respective left and right ski mountaineering boots, said left crampon comprising a front portion wherein the angle γ between the longitudinal axis of the crampon x and the longitudinal axis y of the first coupling seat is a counterclockwise angle γ1, the connecting rod comprising said second selector wherein the longitudinal axis j of said second selector forms a counterclockwise angle β'1 with the longitudinal axis x of the crampon, and said right crampon comprising a front portion wherein the angle γ between the longitudinal axis of the crampon x and the longitudinal axis y of the first coupling seat is a clockwise angle γ2, the connecting rod comprising said second selector wherein the longitudinal axis j of said second selector forms a clockwise angle β'2 with the longitudinal axis of the crampon.

17. A set of two crampons according to claim 16, comprising a left crampon and a right crampon to be coupled to a respective left and right mountaineering boots, said left crampon comprising a front portion wherein the angle γ between the longitudinal axis of the crampon x and the longitudinal axis y of the first coupling seat is a counterclockwise angle γ1, the connecting rod comprising said first selector wherein the longitudinal axis of the first selector k forms a clockwise angle β2 with the longitudinal axis x of the crampon, and the right crampon comprising a front portion wherein the angle γ between the longitudinal axis of the crampon x and the longitudinal axis y of the first coupling seat is a clockwise angle γ2, the connecting rod comprising said first selector wherein the longitudinal axis of the first selector k forms a counterclockwise angle β1 with the longitudinal axis x of the crampon.

18. A set of two crampons according to claim 16, comprising a left crampon and a right crampon to be coupled to a respective left and right mountaineering boots, said left crampon comprising a front portion wherein the angle γ between the longitudinal axis of the crampon x and the longitudinal axis y of the first coupling seat is a counterclockwise angle γ1, the connecting rod comprising said second selector wherein the longitudinal axis j of said second selector forms a clockwise angle β'2 with the longitudinal axis x of the crampon, and the right crampon comprising a front portion wherein the angle γ between the longitudinal axis of the crampon x and the longitudinal axis y of the first coupling seat is a clockwise angle γ2, the connecting rod comprising said second selector wherein the longitudinal axis of the second selector k forms a counterclockwise angle β'1 with the longitudinal axis of the crampon.

* * * * *